US005617444A

United States Patent [19]

Houde-Walter

[11] Patent Number: 5,617,444

[45] Date of Patent: Apr. 1, 1997

[54] LASER GUN AND CARTRIDGE

[75] Inventor: William R. Houde-Walter, Rush, N.Y.

[73] Assignee: LaserMax Inc., Rochester, N.Y.

[21] Appl. No.: 616,957

[22] Filed: Mar. 15, 1996

Related U.S. Application Data

[63] Continuation of Ser. No. 303,327, Sep. 9, 1994, abandoned.

[51] Int. Cl.[6] ..... H01S 3/091

[52] U.S. Cl. ..... 372/77

[58] Field of Search ..... 372/77

[56] References Cited

U.S. PATENT DOCUMENTS

| | | | |
|---|---|---|---|
| 3,271,696 | 9/1966 | DeMent . | |
| 3,300,734 | 1/1967 | DeMent . | |
| 3,309,620 | 3/1967 | DeMent . | |
| 3,414,838 | 12/1968 | DeMent . | |
| 3,537,031 | 10/1970 | DeMent . | |
| 3,546,623 | 12/1970 | DeMent . | |
| 3,618,526 | 11/1971 | Baker | 372/77 |
| 3,646,471 | 2/1972 | DeMent | 372/77 |
| 3,836,865 | 9/1974 | Koehler et al. . | |
| 3,986,137 | 10/1976 | Ehrlich et al. . | |
| 4,016,500 | 4/1977 | Pilloff . | |
| 4,099,142 | 7/1978 | Hershkowitz et al. | 372/77 |
| 4,276,520 | 6/1981 | Rosenberg . | |
| 4,536,879 | 8/1985 | Reed et al. . | |
| 5,052,011 | 9/1991 | Piltch et al. | 372/77 |

*Primary Examiner*—Rodney B. Bovernick
*Assistant Examiner*—Robert E. Wise
*Attorney, Agent, or Firm*—Eugene Stephens & Associates

[57] ABSTRACT

A laser gun uses small arms technology for loading and firing a cartridge containing flash powder. When the cartridge is fired, the flash powder burns to produce an intense burst of light. This light is directed for optically pumping a laser medium that emits an intense pulse of laser light. The cartridge-based small arms technology allows the gun to be easily and conveniently carried about and fired rapidly and reliably.

56 Claims, 3 Drawing Sheets

LASER GUN AND CARTRIDGE

RELATED APPLICATIONS

This application is a Continuation of parent application Ser. No. 08/303,327, filed 9 Sep. 1994, entitled LASER GUN AND CARTRIDGE, now abandoned.

FIELD OF THE INVENTION

The invention relates generally to the field of lasers. More specifically, the invention relates to the field of portable, relatively powerful lasers suitable for use as, for example, weapons.

BACKGROUND

It has long been known that intense light can be used to optically pump lasers. However, typical optical pumping arrangements have resulted in laser systems that are too large, too awkward, or too inconvenient to take seriously as portable. For example, some prior art "portable" lasers rely on electricity as the ultimate source of power for the laser, forcing the user to stay connected to a source of electricity. While portable sources of electricity are available, such as batteries and storage capacitors, they are typically too heavy, too large, or too short-lived to be practical.

I have devised an optically pumped laser that is independent of electricity, lightweight, compact, and portable. The laser is rapid acting, reliable, and conveniently handled by a human like a small arm, such as a hand gun, rifle, or shotgun, to provide an effective and practical laser gun.

SUMMARY OF INVENTION

My laser gun uses a flash powder cartridge as a light source. The cartridge is similar in size and shape to cartridges used in small arms, except that instead of propelling a bullet down a gun barrel, my cartridge produces a flash of intense light that pumps a laser medium, such as a solid rod of laser material. The use of small arms technology for loading and firing the cartridges allows my laser gun to produce repeated and reliable flashes of intense light as the flash powder cartridges detonate.

The light is emitted by burning gases that are blown down a gun barrel-like passageway into a laser chamber. The chamber is reflective and preferably focuses the light so that the laser medium produces a directed beam or pulse of laser light. The laser medium can be surrounded by the gases, or the gases can be directed along a focal axis of an elliptical region that contains the laser medium on the other focal axis. In another configuration, the gases are directed through a laser chamber of parabolic cross section in which the laser medium is mounted along the parabolic focal axis. In any configuration, these arrangements are made to direct the light from the cartridge to the laser medium, for optical pumping purposes, to produce a brief beam of directed light consistently and reliably for each cartridge fired.

DRAWINGS

DETAILED DESCRIPTION

Figure 1:
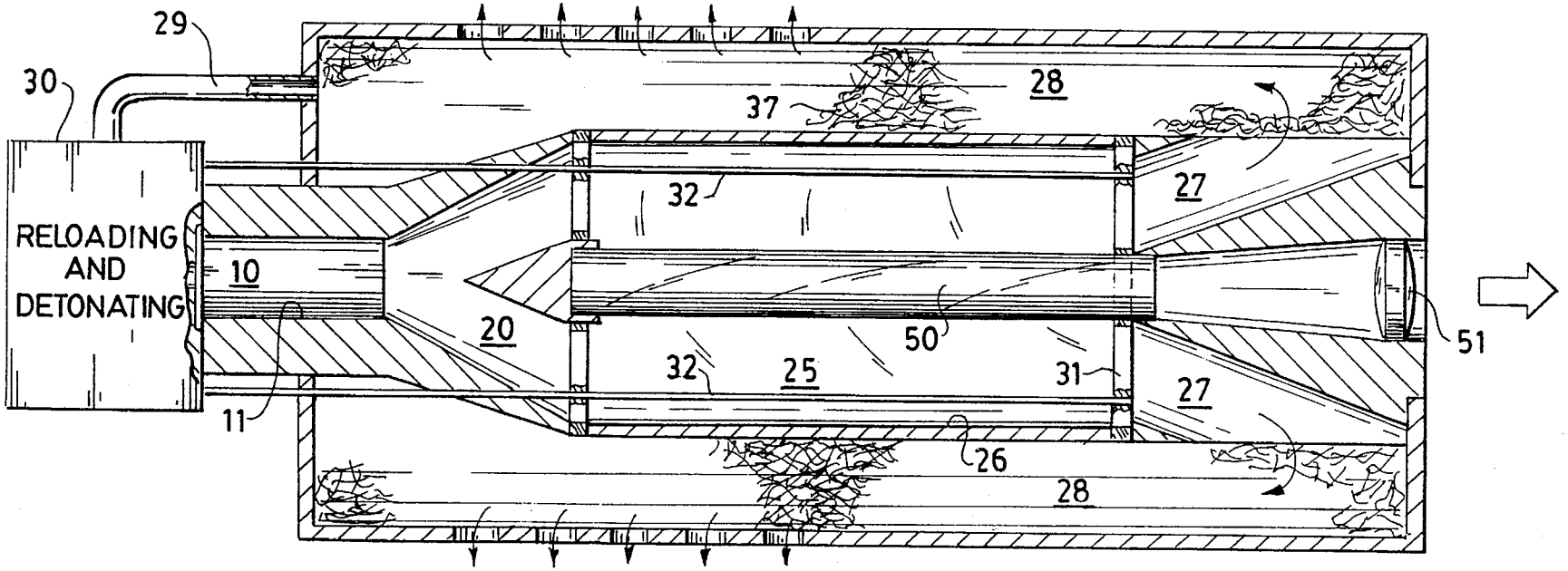
FIG. 1 is a schematic diagram of a preferred embodiment of a laser gun according to my invention.
Figure 7:
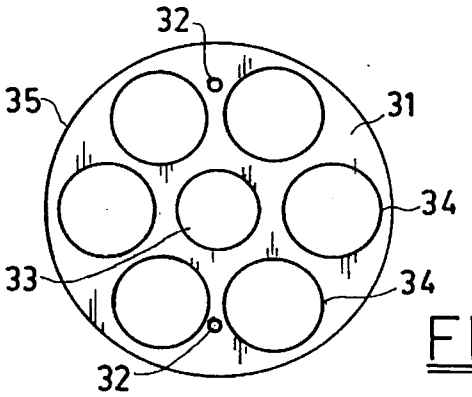
FIG. 7 is an end view of a cleaning element movable within the laser chamber of the embodiment of FIG. 1.

My invention embodies a practical and effective laser gun that uses small arms technology such as is well established for rifles, shotguns, and hand guns. Since small arms technology is well understood, I have illustrated those aspects of the invention which utilize small arms technology only schematically in the drawings. My laser gun uses a cartridge 10 detonated within a cartridge chamber 11 as its light source. This allows the use of small arms technology to automatically chamber cartridges, fire them with a pin striking a primer 13, eject the cartridge casing 12, and load another round.

Figure 6:
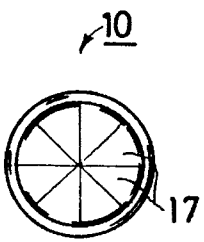
FIG. 6 is a view of a crimped end of the cartridge of FIG. 5.
Figure 5:
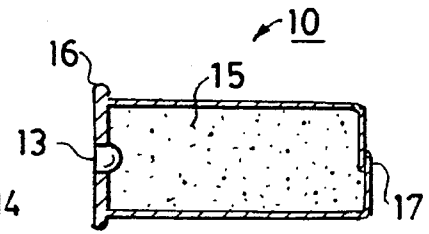
FIGS. 4 and 5 are cross-sectional views of preferred cartridge embodiments for use in my laser gun.
Figure 4:
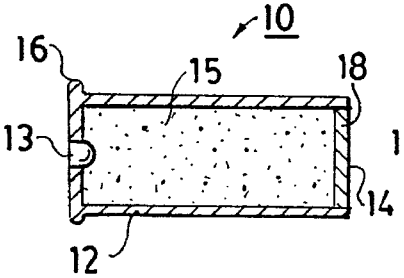

The departure from standard small arms technology lies in the material loaded in the cartridge and the purpose for which the cartridge 10 is used. Because the invention uses firearm cartridges to produce a flash of intense light instead of propelling a projectile, a combustible flash material 15, such as flash powder, is contained by the cartridge 10. The cartridge 10 can assume several forms, each of which is preferably analogous to firearm cartridges used in small arms. Thus, as shown in FIGS. 4–6, cartridges 10 can have casings 12 formed all or partly of metal to include primers 13. Cartridges 10 can thus resemble rifle, handgun, or shotgun shells.

The combustible flash material 15 can be held in the casing 12 by a binder material that confines the powder as shown in FIG. 4. A retainer 18 can also be used to contain the flash material 15 within the casing 12. The primer end of casing 12 preferably has a rim 16 fixing its position within the cartridge chamber 11, and the open or output end 14 of a casing 12 can be closed with crimping 17, as shown in FIGS. 5 and 6.

Caseless cartridges can also be used in the invention and have been used with some success in conventional small arms. When caseless cartridges are used, the entire cartridge burns when detonated, leaving no casing to be ejected from the cartridge chamber 11. Caseless cartridges are typically made of explosive compositions held together with binders so that they can be safely handled without accidentally detonating or cooking off in a hot chamber 11 before being deliberately fired by striking primer 13.

Flash powder 15 is preferably formed of a finely divided powdered metal such as magnesium, aluminum, copper, titanium, or hafnium, combined in mixtures with appropriate oxidizers such as nitrates, chlorates, perchlorates, and dichromates. Alternatives and additives can include triethylaluminum, diethyl zinc, xenon tetrafluoride, and nitrated dyes such as BASF 37 nitrated with nitric acid in a dry ice slush. Stabilizing compounds such as plastics, starch, and cellulose can be added to these mixtures to improve safety and eliminate spontaneous explosion from heat or shock.

The flash powder materials are selected and composed to produce a flash of intense light in the rapid combustion or detonation that occurs upon firing a cartridge 10. Preferably, the spectrum of the brilliant flash of light is selected by proper composition of the flash powder so that the light burst pumps the laser medium more effectively and efficiently to produce a more intense output beam of laser light.

Using firearm cartridges charged with flash powder or the like and using small arms technology for handling and detonating the cartridges allow my laser gun to be fired rapidly and reliably. Directing each cartridge explosion so that its resultant burst of intense light effectively pumps a laser medium then causes the gun to shoot a substantial pulse of laser light on each firing.

A passageway 20 leads from the cartridge chamber 11 and is in fluid communication with a laser chamber 25. The passageway 20 allows expanding and light-emitting gases from a detonation of cartridge 10 to blow around or past a laser medium 50 mounted in the laser chamber 25. Passageway 20 is thus analogous to and can take the form of a gun barrel down which expanding gases flow in ways understood in small arms technology. In the embodiment of FIG. 1, the passageway 20 directs the detonation gases to surround laser medium 50 in a cylindrical laser chamber 25. Preferably, the laser medium 50 is a rod of solid lasing material. The internal surface 26 of laser chamber 25 is highly reflective so that light from the gases burning in chamber 25 is reflected toward and preferably focused on the laser medium 50. As shown in FIG. 1, the laser medium 50 extends along the center or focal axis of the laser chamber 25. Light focused into the rod 50 stimulates the rod 50 to produce an output pulse of laser light. The pulse is directed axially of laser rod 50, through a lens system 51 to an output beam or pulse shown by an arrow. In all embodiments of my laser gun, as can clearly be seen from the drawings, the laser medium is mounted in such a way that the action of firing the gun does not disturb the manner in which the beam leaves the gun. Laser pulses will consistently be emitted along the axis of the laser medium, which is aligned with a major axis of the gun. As is conventional in small arms, sights can be included for aiming the gun.

Laser rod 50 can be formed of various laser media in preferably a solid state form. These can include ruby, NdYAG, NdGlass, rare earth glass, YAG, alexandrite, diamond, solid vapor, and polymer dye laser systems. Laser media can also be liquid or gaseous. The laser medium is selected partly for the frequency of the light desired in the output pulse and partly for compatibility with the flash powder so that optical pumping will effectively produce an intense laser output. This can range through ultraviolet, visible, and infrared portions of the electromagnetic spectrum and can include X-ray and microwave.

Hot burning gases passing beyond laser chamber 25 are directed outward through a plurality of exhaust passageways 27 into a silencer chamber 28 that can be filled with a silencing material, such as steel wool. Gases are vented from silencer chamber 28, and a portion of the gases expanding in silencer chamber 28 can be applied to passageway 29 to provide a power source for reloading and detonating mechanism 30. This operates in generally known ways, using small arms technology, which includes several successful actuators for gas-powered reloading mechanisms.

A cleaning device 31, moved by actuating rods 32, which are preferably driven by reloading device 30, is sized for moving along laser chamber 25 to clean away residue of combustion from the outer surface of laser rod 50 and the inner reflective surface 26 of laser chamber 25. This keeps the interior surfaces within laser chamber 25 clean and bright for optical reflectivity. A central hole 33 in cleaning device 31 slides along laser rod 50, and outer surface 35 slides along reflective surface 26. The surfaces of hole 33 and perimeter 35 can be configured and formed of suitable materials for optimum cleaning of combustion residue. A ring of passageway holes 34 allows burning gases to pass from laser chamber 25 through cleaning device 31 and into output gas passageways 27. If heat-conducting material is used in the manufacture of cleaning device 31, it can also act as a heat sink to remove excess heat from the laser medium.

Figure 2:
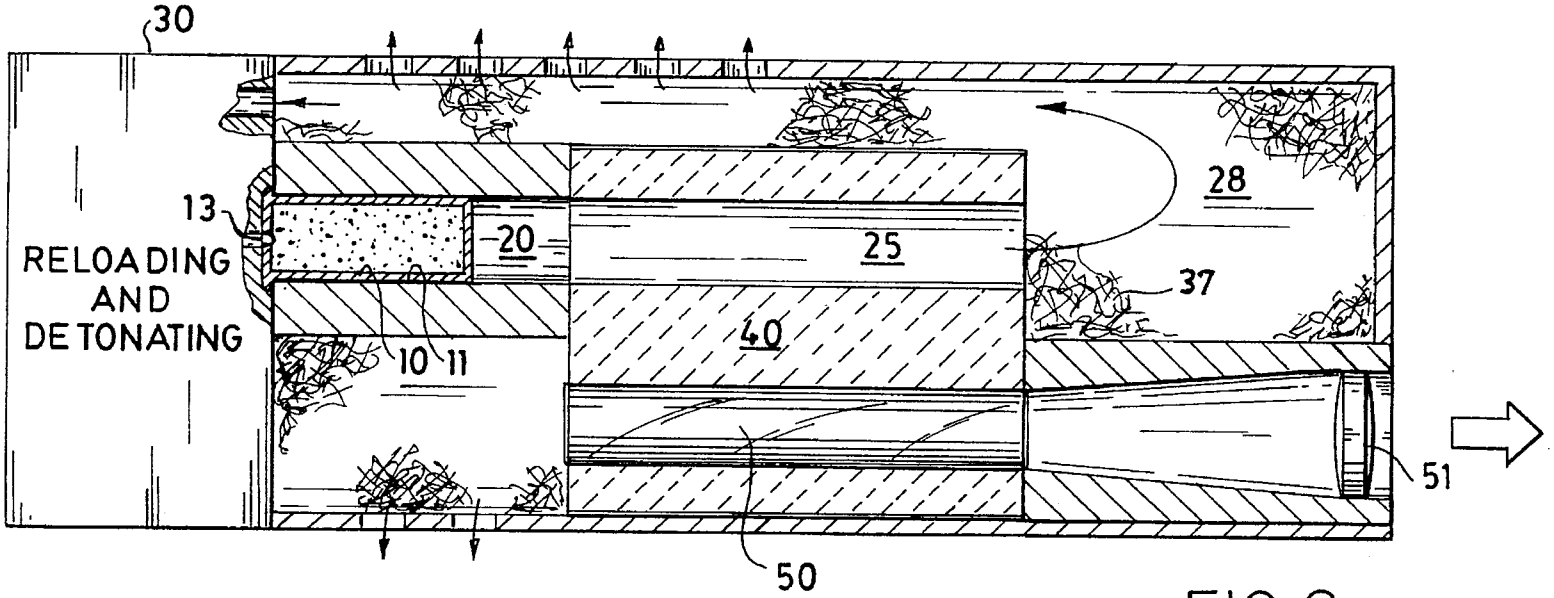
FIG. 2 is a schematic diagram of another preferred embodiment of a laser gun according to my invention, using an elliptical laser chamber.

The passageway 20 for conducting burning gases from cartridge chamber 11 into laser chamber 25 is arranged in a different way in the embodiment of FIG. 2. In this embodiment, the laser chamber 25 has an elliptical cross section and the laser medium 50 is mounted on one focal axis of the chamber 25. The passageway 20 enters the laser chamber 25 at the other focal axis of the laser chamber 25. The internal surface 26 of the laser chamber 25 is reflective. When light-emitting gases from detonation of the cartridge 10 enter the laser chamber 25, the light is focused on the laser medium 50 to produce an output beam or pulse of laser light passed through a lens system 51 as represented by an arrow in FIG. 2. The gases can then be passed through the silencer 28 in a manner similar to that employed in the first embodiment.

Figure 3:
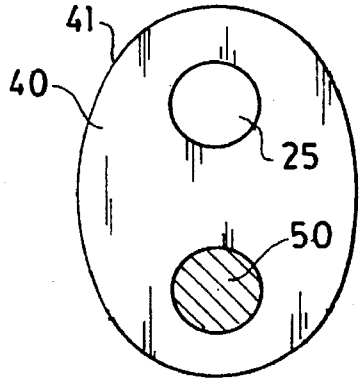
FIG. 3 is an end view of an elliptical element usable in the embodiment of FIG. 2.

Alternatively, the passageway 20 extends into a bore hole along a focal axis of an elliptical element 40 that holds laser rod 50 on its other elliptical axis, as shown in FIGS. 2 and 3. The outer surface 41 of elliptical element 40 is made highly reflective so that light from the light-emitting gases in the laser chamber 25 is internally reflected within elliptical element 40, where it is directed toward the companion focal axis containing laser rod 50. The laser pulse pumped out from the rod 50 is directed through lens system 51 as represented by an output arrow. The elliptical element 40 is preferably made of a solid material that is highly transmissive of the light from the burning flash material, such as high-temperature and high-strength glass, diamond, ruby, or any other suitable material. The laser rod 50 is preferably also formed of a solid material as described in relation to the first embodiment of the invention.

Figure 9:
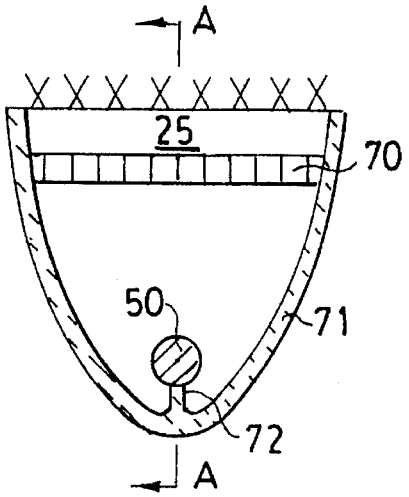
FIG. 9 is a schematic end view of a third preferred embodiment of a laser gun according to my invention.
Figure 10:
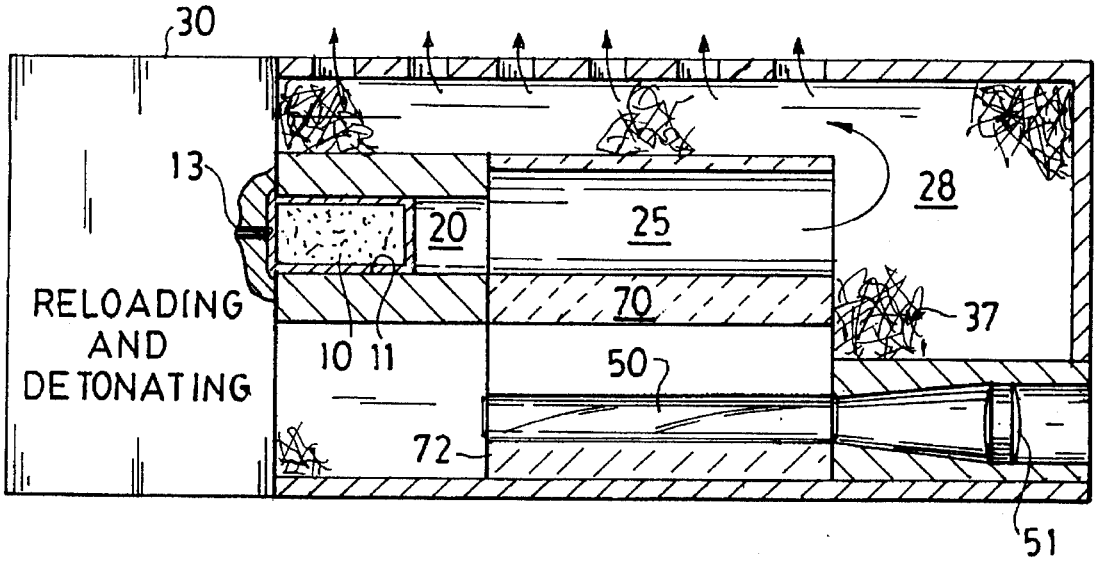
FIG. 10 is a view taken along line A—A in FIG. 9.

The laser chamber 25 of my laser gun can also be constructed using a reflective chamber of parabolic cross section as shown in FIGS. 9 and 10. In this embodiment, a light-transmitting window 70 is placed in the laser chamber 25 to form an extension of passageway 20 at the wide side of a parabolic reflector 71. The light-transmitting window 70 can be made from high-temperature and high-strength glass, diamond, ruby, or any other suitable material. The laser medium 50 is supported such that its longitudinal axis coincides with the focal axis of the reflector 71. Support for the laser medium 50 can be provided by supporting its ends. Alternatively, the laser medium can be affixed to a supporting ridge 72 formed along the internal surface of the extremum of the parabolic reflector 71 with adhesive or the like.

Use of a light-transmitting window 70 prevents residue from the detonation of the cartridge 10 from being deposited on the laser medium 50, as well as the bulk of the surface of parabolic reflector 71. Instead, the residue is deposited on the surface of the light-transmitting window 70 where it can be more easily removed. A modified version of cleaning device 31 can be included in this embodiment to allow easy, automatic cleaning of the light-transmitting window 70.

Figure 8:
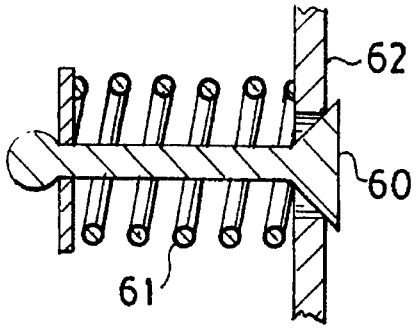
FIG. 8 is a schematic diagram of a choke valve which can be used in all embodiments of my invention.

To further enhance operation of my laser gun, a choke valve 60 can be interposed between the cartridge chamber 11 and the passageway 20 in a partition wall 62, as illustrated in FIG. 8. A spring 61 biases the choke valve 62 such that the expanding and light-emitting gases from the exploding cartridge 10 are not permitted to enter the passageway 20 until a particular pressure is reached. The particular pressure should be at least 1,000 Copper Units of Pressure (CUP), with an upper value of around 50,000 CUP and an optimum value of about 20,000 CUP. This delay in the release of the expanding and light-emitting gases intensifies the laser output of the laser medium 50 since the greater pressure causes more light to be produced. Deposits of residue in the laser chamber 25 and/or on the laser medium 50 are reduced because combustion is more complete by the time the gases get to the laser chamber 25.

Use of the valve 60 yields a more constant-intensity output from the laser gun as well. Without the choke valve 60, the expanding and light-emitting gases increase their light output as they travel through the laser chamber 25. With the choke valve 60, however, the gases can be kept out of the laser chamber 25 until they have reached or nearly reached maximum light output. When the gases subsequently pass through the laser chamber 25, they put out a sudden, nearly constant burst of light instead of a burst which is ever-increasing as the gases pass through the laser chamber 25. Besides creating an optimum light pulse, this can reduce contamination of laser chamber 25 from unburned powder.

An additional benefit of use of the choke valve 60 is that, due to its proximity to the chamber 11, a normal bullet will not fit into the chamber 11. This prevents an operator of the laser gun from firing a normal bullet through the laser chamber 25, which would destroy the lasing equipment therein. An additional advantage of the choke valve is controlling pulse length and pulse shape for applications such as harmlessly dazing the human visual system.

I claim:

1. A laser gun comprising:

a. a laser medium mounted in a light-reflective laser chamber;

b. a source of light for pumping the laser medium, the light source comprising a chemically combustible flash material contained within a small arms cartridge;

c. a small arms cartridge chamber and detonating mechanism arranged to receive and mechanically detonate the cartridge so that burning and light-emitting gases expand from the light source;

d. a passageway extending from the cartridge chamber to the laser chamber so that gases expanding from the cartridge chamber emit light within the laser chamber; and e. the mounting of the laser medium in the laser chamber is arranged so that the laser medium is pumped by light from the light-emitting gases from the source when the gases burn and emit light in the laser chamber.

2. The gun of claim 1 wherein a spectrum of light from the source is effective for pumping the laser medium mounted in the laser chamber.

3. The gun of claim 1 wherein said laser medium is a solid rod supported at opposite ends.

4. The gun of claim 1 wherein said gases emit light from a region that substantially surrounds said laser medium.

5. The gun of claim 1 wherein said light-reflective chamber has an elliptical cross section, said passageway extends along one focal axis of said reflective chamber, and said laser medium is mounted along another focal axis of said reflective chamber.

6. The gun of claim 5 wherein said reflective chamber is filled with a light-transmitting material except for bores along said focal axes, said passageway extending through one of said bores, with the laser medium being mounted in the other of said bores.

7. The gun of claim 1 wherein said passageway is surrounded by a silencer chamber.

8. The gun of claim 1 including a reloading mechanism driven by a portion of said expanding gases for automatically placing another cartridge in said chamber after a detonation.

9. The gun of claim 1 including a cleaning device movable in said passageway around said laser medium for cleaning away combustion residue, said cleaning device being driven by a portion of said gases.

10. The gun of claim 9 wherein at least a portion of said cleaning device is made of heat-conductive material with which the cleaning device can remove heat from the laser medium.

11. The gun of claim 1 including a choke valve assembly interposed between said cartridge chamber and said passageway, said choke valve preventing passage of said expanding and light-emitting gases until a particular pressure is achieved in said cartridge chamber.

12. The gun of claim 11 wherein said choke valve assembly includes a valve biased by a spring.

13. The gun of claim 11 wherein said particular pressure is in the range of from 1,000 CUP to 50,000 CUP.

14. The gun of claim 13 wherein said particular pressure is 20,000 CUP.

15. The gun of claim 1 wherein said reflective chamber has a parabolic cross section and said laser medium is arranged along a focal axis of said reflective chamber.

16. The gun of claim 15 wherein said laser medium is affixed to a support ridge extending from an internal external surface of said reflective chamber.

17. The gun of claim 15 wherein said laser medium is supported at opposite ends.

18. The gun of claim 15 wherein a light-transmitting window is interposed between said gases and said laser medium in said laser chamber.

19. The gun of claim 18 wherein a cleaning device is provided in said extension of said passageway to clean the surface of said light-transmitting window.

20. The gun of claim 19 wherein at least a portion of said cleaning device is made of heat-conductive material with which the cleaning device can remove heat from the light-transmitting window.

21. A laser gun using a laser medium and a material that emits intense light, said laser gun comprising:

a. a firearm cartridge chamber arranged at a breech end of a barrel of said gun to receive a firearm cartridge loaded with a chemically combustible flash material that blows down said gun barrel as it burns to produce an intense light;

b. a laser medium arranged in a light-reflective laser chamber to receive said intense light emitted as said flash material blows down said gun barrel, said intense light pumping said laser medium to emit a laser beam; and c. a loading and detonating system for loading said firearm cartridge into said cartridge chamber and detonating said firearm cartridge within said cartridge chamber to direct ignited flash material down the gun barrel and into the laser chamber.

22. The gun of claim 21 wherein said laser medium is arranged on an axis of said gun barrel.

23. The gun of claim 21 wherein said light-reflective chamber has an elliptical cross section, said gun barrel is arranged along one focal axis of said reflective chamber, and said laser medium is mounted along another focal axis of said reflective chamber.

24. The gun of claim 23 wherein said elliptical laser chamber outside of said laser medium and said gun barrel is filled with a light-transmitting, solid material.

25. The gun of claim 21 wherein a silencer surrounds said gun barrel.

26. The gun of claim 21 including an automatic cartridge ejecting and reloading mechanism powered by a portion of said gases.

27. The gun of claim 21 including a cleaning device movable along said gun barrel for cleaning away combustion residue.

28. The gun of claim 27 wherein at least a portion of said cleaning device is made of heat-conductive material with which the cleaning device can remove heat from the laser medium.

29. The gun of claim 21 wherein said laser medium is a solid rod supported at opposite ends.

30. The gun of claim 21 including a choke valve assembly interposed between said cartridge chamber and said gun barrel, said choke valve preventing passage of said flash material until a particular pressure is achieved in said cartridge chamber.

31. The gun of claim 30 wherein said choke valve assembly includes a valve biased by a spring.

32. The gun of claim 30 wherein said particular pressure is in the range of from 1,000 CUP to 50,000 CUP.

33. The gun of claim 32 wherein said particular pressure is 20,000 CUP.

34. The gun of claim 21 wherein said reflective chamber has a parabolic cross section and said laser medium is arranged along a focal axis of said reflective chamber.

35. The gun of claim 34 wherein said laser medium is affixed to a support ridge extending from an internal external surface of said reflective chamber.

36. The gun of claim 34 wherein said laser medium is supported at opposite ends.

37. The gun of claim 34 wherein a light-transmitting window is interposed between said flash material and a portion of said reflective chamber to form an extension of said passageway through which said flash material passes after detonation of said cartridge.

38. The gun of claim 37 wherein a cleaning device is provided in said extension of said passageway to clean the surface of said light-transmitting window.

39. The gun of claim 38 wherein at least a portion of said cleaning device is made of heat-conductive material with which the cleaning device can remove heat from the light-transmitting window.

40. A laser gun and cartridge comprising:

a. a small arms cartridge containing a combustible flash material that produces light-emitting gases when detonated;

b. a small arms chamber for receiving and permitting the detonation of the cartridge;

c. a passageway extending from the chamber to allow expansion of light-emitting gases upon detonation of the cartridge;

d. a laser medium mounted in a reflective laser chamber in light communication with the passageway so that light from the gases illuminates the laser medium mounted in the laser chamber; and e. the flash material being selected so that the light has a spectrum that effectively pumps the laser medium to emit a pulse of laser light from the laser medium.

41. The gun of claim 40 wherein said passageway extends through the laser chamber and encircles said laser medium.

42. The gun of claim 40 wherein said light-reflective chamber has an elliptical cross section, said passageway extends along one focal axis of said reflective chamber, and said laser medium is mounted along another focal axis of said reflective chamber.

43. The gun system of claim 42 wherein said elliptical laser chamber outside said laser medium and said passageway is filled with a light-transmitting solid material.

44. The gun of claim 40 including a cleaning device movable along said passageway to remove combustion residue.

45. The gun of claim 44 wherein at least a portion of said cleaning device is made of heat-conductive material with which the cleaning device can remove heat from the laser medium.

46. The gun of claim 40 wherein said laser medium is a solid rod supported at opposite ends.

47. The gun of claim 40 including a choke valve assembly interposed between said cartridge chamber and said passageway, said choke valve preventing passage of said expanding and light-emitting gases until a particular pressure is achieved in said cartridge chamber.

48. The gun of claim 47 wherein said choke valve assembly includes a valve biased by a spring.

49. The gun of claim 47 wherein said particular pressure is in the range of from 1,000 CUP to 50,000 CUP.

50. The gun of claim 49 wherein said particular pressure is 20,000 CUP.

51. The gun of claim 40 wherein said reflective chamber has a parabolic cross section and said laser medium is arranged along a focal axis of said reflective chamber.

52. The gun of claim 51 wherein said laser medium is affixed to a support ridge extending from an internal external surface of said reflective chamber.

53. The gun of claim 51 wherein said laser medium is supported at opposite ends.

54. The gun of claim 51 wherein a light-transmitting window is interposed between said gases and a portion of said reflective chamber to form an extension of said passageway through which said gases pass after detonation of said cartridge.

55. The gun of claim 54 wherein a cleaning device is provided in said extension of said passageway to clean the surface of said light-transmitting window.

56. The gun of claim 55 wherein at least a portion of said cleaning device is made of heat-conductive material with which the cleaning device can remove heat from the light-transmitting window.

* * * * *